US006257458B1

(12) United States Patent
Green

(10) Patent No.: US 6,257,458 B1
(45) Date of Patent: Jul. 10, 2001

(54) SELF-PRIMING HAND PUMP FOR DISPENSING FLUID TO A BOVINE

(76) Inventor: Jerold L. Green, 955 E. County Club Rd., Gering, NE (US) 69341

( * ) Notice: Subject to any disclaimer, the term of this patent is extended or adjusted under 35 U.S.C. 154(b) by 0 days.

(21) Appl. No.: 09/377,641

(22) Filed: Aug. 19, 1999

(51) Int. Cl.[7] ..... B65D 88/54

(52) U.S. Cl. ..... 222/321.9; 222/385; 222/464.3; 222/527

(58) Field of Search ..... 222/341, 321.7, 222/321.9, 385, 464.3, 527

(56) References Cited

U.S. PATENT DOCUMENTS

| | | | | |
|---|---|---|---|---|
| 2,519,640 | * | 8/1950 | Echols, Sr. et al. | 222/341 |
| 3,458,090 | * | 7/1969 | Scoggin, Jr. | 222/321.9 |
| 4,548,344 | * | 10/1985 | Hestehave et al. | 222/527 |
| 5,381,932 | * | 1/1995 | Humphrey | 222/321.9 |

* cited by examiner

*Primary Examiner*—Kevin Shaver
*Assistant Examiner*—David Deal

(74) *Attorney, Agent, or Firm*—Zarley, McKee, Thomte, Voorhees & Sease

(57) ABSTRACT

A hand pump includes a body member having lower and upper ends, a cavity formed between the ends and an inlet opening that fluidly connects the cavity with a fluid reservoir. A piston assembly is slidably mounted in the cavity and includes a plunger tube slidably extending through a hole in the body member and a piston secured against axial movement on the plunger tube. The plunger tube has an inlet end disposed within the cavity and an outlet end disposed at the upper end of the plunger tube outside the cavity. A first gravity-operated check valve disposed in the cavity below the piston assembly blocks the inlet openings. When the check valve is closed, fluid cannot flow between the cavity and the reservoir. However, when the first check valve is open, fluid can flow between the reservoir and the cavity. A second gravity-operated check valve is associated with the outlet end of the plunger tube. When the second check valve is open, fluid can be discharged from the cavity through the plunger tube. However, when the second check valve is closed, fluid cannot be discharged from the cavity through the plunger tube. A spring yieldingly biases the piston assembly toward the upper end of the body member and, in conjunction with the check valves, automatically primes the pump.

6 Claims, 4 Drawing Sheets

SELF-PRIMING HAND PUMP FOR DISPENSING FLUID TO A BOVINE

BACKGROUND OF THE INVENTION

The present invention relates to the field of animal husbandry. More particularly, this invention relates to a self-priming hand pump for dispensing fluid to a bovine.

Feedlot personnel often administer liquid food supplements and the like to cattle, sheep and other bovine by inserting a probe into the animal's esophagus through its mouth. This is a delicate procedure that must be performed quickly and with great care to minimize the risk of the probe damaging the animal's esophagus. Unfortunately, the animals do not generally cooperate with the procedure and are difficult to hold still for very long. Even when utilizing conventional head gates to partially immobilize the bovine's head, it is often difficult to quickly and smoothly administer the desired dosage before the animal moves.

Liquid food supplement is typically provided to the animal through the probe in one of two ways, both of which are rather awkward. The first way involves feedlot personnel elevating a graduated container above the animal's head with one hand while attempting to hold the animal and the drenching probe in the animal's mouth with the other hand. The container must be lowered when the desired volume of fluid has been dispensed to the bovine. It is difficult to accurately control the volume of fluid dispensed using this means and method.

If gravity is not used to get fluid from the reservoir to the probe, a pump or a large syringe must be used to measure out and deliver the desired volume of fluid. However, conventional syringes and pumps first must be primed with fluid before they are able to start discharging fluid into the probe. The priming of the pump or syringe is an extra step that must be performed in conjunction with administering the liquid food supplement to the animal. Therefore, there is a need for an automatically self-priming hand pump to improve the procedure.

A primary objective of the present invention is the provision of a self-priming hand pump for administering fluid to a bovine.

Another objective of the present invention is the provision of a self-priming hand pump that is directly attachable to a bucket containing liquid food supplements and the like.

Another objective of the present invention is the provision of a self-priming hand pump that utilizes a spring-biased piston assembly and pair of gravity-operated check valves to automatically prime itself.

Another objective of the present invention is the provision of a self-priming hand pump that has an adjustable means for establishing a particular fluid discharge volume or amount to be given to the animal.

Another objective of the present invention is the provision of a self-priming hand pump that is economical to manufacture, easy to operate with a single hand, as well as durable and reliable in use.

These and other objectives will be apparent from the drawings, as well as from the description that follows.

SUMMARY OF THE INVENTION

The present invention relates to the field of animal husbandry. More particularly, the present invention relates to a self-priming hand pump for dispensing fluid to a bovine.

The self-priming hand pump includes a body member having lower and upper ends, a cavity formed between the ends and an inlet opening that fluidly connects the cavity with a fluid reservoir. A piston assembly is slidably mounted in the cavity. The piston assembly includes a substantially upright and elongated plunger tube slidably extending through a hole in the body member and a piston secured against axial movement on the plunger tube. The plunger tube includes an inlet end disposed within the cavity and an outlet end disposed at the upper end of the plunger tube outside the cavity.

A first gravity-operated normally closed check valve disposed in the cavity below the piston assembly blocks the inlet openings so that when the check valve is closed, fluid cannot flow between the cavity and the reservoir. However, when the first check valve is open, fluid can flow between the reservoir and the cavity.

A second gravity-operated normally closed check valve is operatively connected to the outlet end of the plunger tube such that when a second check valve is open, fluid can be discharged from the cavity through the plunger tube. However, when the second check valve is closed, fluid cannot be discharged from the cavity through the plunger tube. A spring yieldingly biases the piston assembly toward the upper end of the body member.

The spring and the two gravity-operated check valves cooperate to provide a pump which is self-priming. The spring urges the piston assembly to return to an extending position after being forced downwardly by the user. During the return stroke, the check valves cause the pump to be primed. A clip can be attached to the plunger tube to limit its travel in a downward direction, thereby limiting the volume or amount of liquid supplied to the bovine.

DETAILED DESCRIPTION OF THE PREFERRED EMBODIMENT(S)

Figure 1:
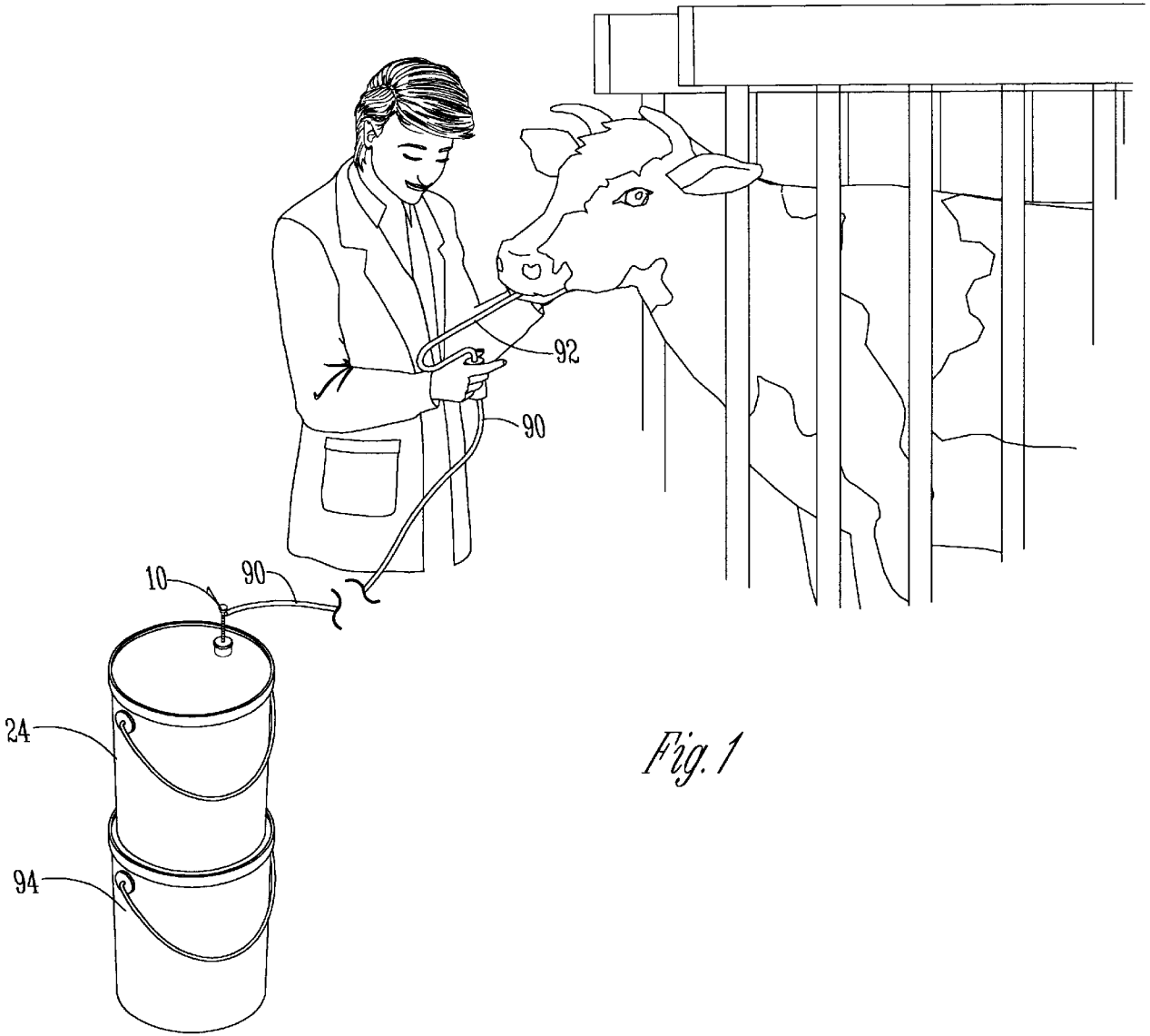
FIG. 1 is a perspective view of the hand pump of this being used to administer liquid food supplements to a bovine.

In the figures and the description that follows, the hand pump of the present invention is generally designated by the reference numeral 10. Referring to FIGS. 2–6, the hand pump 10 includes an elongated cylindrical tube or body member 12 having upper and lower ends 14, 16. A suction nozzle 18 is attached to the lower end 16 of the body member 12. An inlet opening 20 extends through the suction nozzle 18 so as to connect a cavity 22 formed in the body member 12 with a fluid reservoir 24.

A piston assembly 26 is slidably mounted in the cavity 22 as to define a fluid chamber 28 in the lower portion of the cavity 22. The piston assembly 26 includes a piston 30 secured against axial movement along an elongated hollow plunger tube 32. The piston 30 has at least one conventional sealing ring thereon, preferably a seal 31 having a rectangular cross-section and an o-ring 33 having a round cross-section. The tube 32 extends through a hole 34 in the upper end 14 of the body member 12. The plunger tube 32 is in fluid communication with the fluid chamber 28 and has upper and lower ends 36, 38. The lower end 38 is disposed in the cavity 22 and the upper end 36 extends outside the cavity 22 to define an outlet opening 40.

A first check valve 42 is operatively associated with the inlet opening 20. Preferably the first check valve comprises a check ball 44 which is upwardly adjacent a conical seat 46 formed around the inlet opening 20 into the cavity 22. However, a variety of check valve shapes and seat shapes will work, so long as the check valve 42 is gravity-operated. The first check valve 42 normally blocks the inlet opening 20 unless the piston assembly 26 moves toward the upper end 14 of the body member 12. A spring 48, preferably a coiled compression spring having an inner diameter greater than the diameter of the check ball, is operatively interposed between the piston assembly and the body member 12 or the nozzle 18. The spring 48 yieldingly biases the piston assembly upwardly toward the upper end 16 of the body member 12 in the absence of a downward force being applied to the plunger tube 32.

The body member 12 has a cap 50 attached to its upper end 14. The cap 50 has a small hole 52 extending therethrough and into the cavity 22 of the body member 12. The hole 52 acts a vent to relieve or vent to the atmosphere any pressure built up above the piston 30. The cap 50 also has a centrally located hole 54 therethrough for slidingly receiving the plunger tube 32. The cap 50 has a lower surface 56 extending generally transverse to the body member 12. A threaded counterbore 58 extends into the lower surface of the cap 50. The threaded counterbore 58 matingly engages a threaded annular flange 60 which surrounds a pour spout opening 62 on the reservoir 24. Thus, the body member 12 is attached to the reservoir 24 in a substantially upright position. The lower end 16 of the body member 12 extends downwardly inside the reservoir 24. To better reach fluid at the bottom of the reservoir 24, an elongated suction tube is attached to the section nozzle 18 by frictionally engaging it with a hose barb 64.

The exposed portion of the plunger tube 32 has a plurality of axially spaced annular grooves 66 in its outer diameter. Preferably the grooves 66 are equally spaced along the exposed length of the plunger tube 32. The grooves 66 are adapted to receive a hairpin clip 67, which acts as an abutment means to limit the axial travel of the plunger 32 in one direction. The clip 67 abuts the cap 50 on the upper end 14 of the body member 12. The amount or volume of fluid displaced by the pump can thus be set to a particular value and increased or decreased in fixed increments.

A knob 68 having an enlarged head 70 is attached to the upper end 36 of the plunger tube 32. A fluid passageway 72 extends through the knob and is in fluid communication with the cavity 22 through the plunger tube 32. A second check valve 74 is disposed at the outlet opening 40 at the upper end 36 of the plunger end 32. Preferably the check valve 74 includes a check ball 76 for engaging a seat 78 at the upper end 36 of the plunger tube 32. The second check valve 74 is gravity-operated based upon the structure described below.

The fluid passageway 72 in the knob 70 is T-shaped. A hose barb 80 is threadedly attached to the knob 68 and has a fluid passage 82 therethrough which selectively connects with an upright passageway 84 that houses the check ball 76. The passageway 84 is larger in diameter than the check ball 76 and extends far enough upwardly so that the ball 76 can be pushed off of the seat 78 and fluid can flow from the plunger tube 32 into the hose barb 80. Essentially, the fluid pressure created in the fluid chamber 28 by the downward movement of the piston assembly 26 forces the check ball 76 off its seat 78. However, under normal conditions, the check ball 76 will be urged by gravity to block the seat 78. A shallow groove 86 having a radius approximately equal to that of the check ball 76 extends at least radially across the inward end of the hose barb 80. The groove intersects the fluid passageway 82 so that the check ball 76 will not fully block the passageway 82. Thus, fluid can always flow around the ball 76 and through passageway 82 when the second check valve 74 is open.

Figure 2:
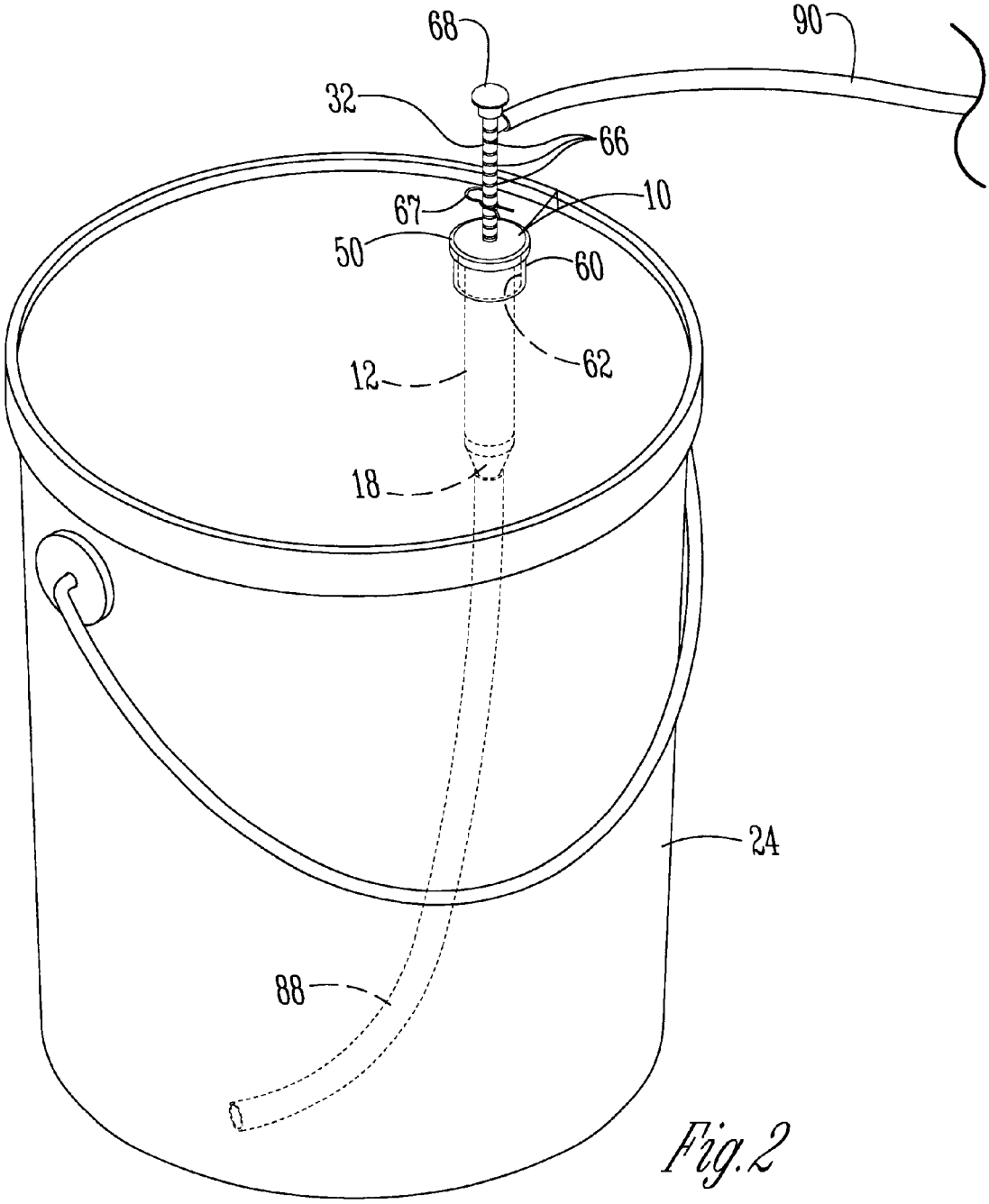
FIG. 2 is a perspective view of the hand pump of FIG. 1 mounted on a fluid reservoir.
Figure 3:
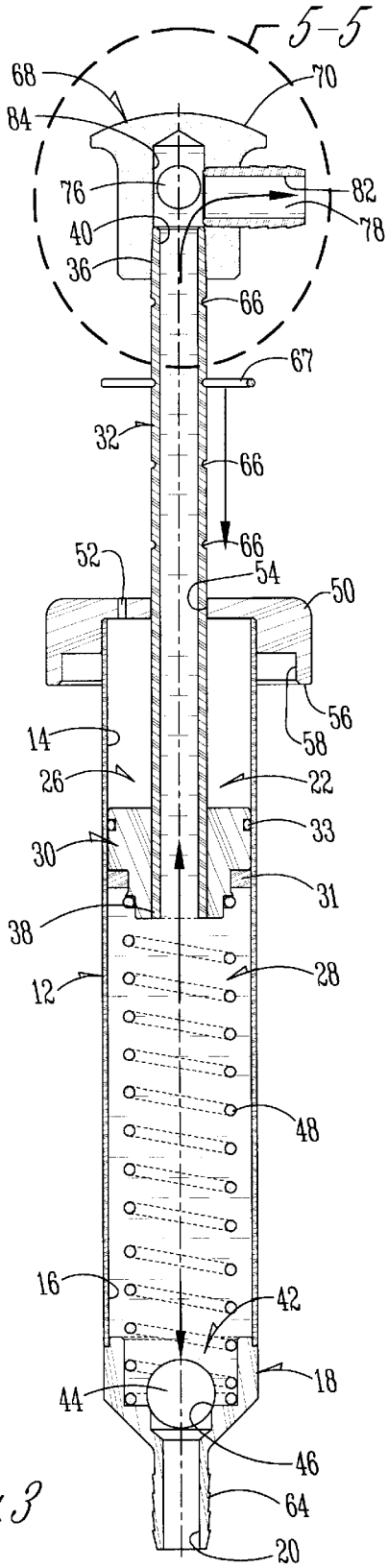
FIG. 3 is a central longitudinal cross-sectional view of the hand pump of this invention in a fluid discharging mode.
Figure 4:
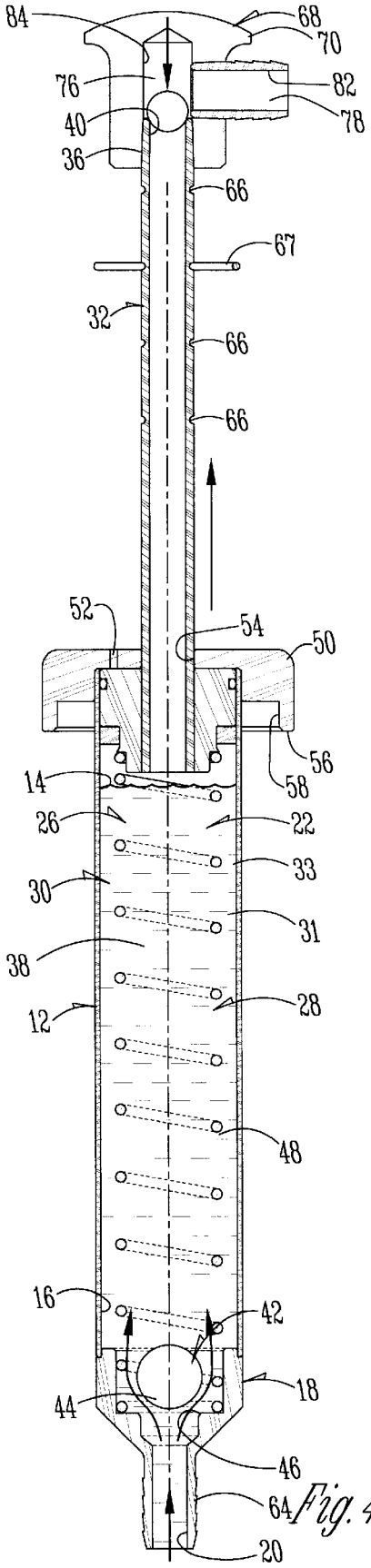
FIG. 4 is a cross-sectional view similar to FIG. 3, but shows how the hand pump is automatically self-primed.
Figure 5:
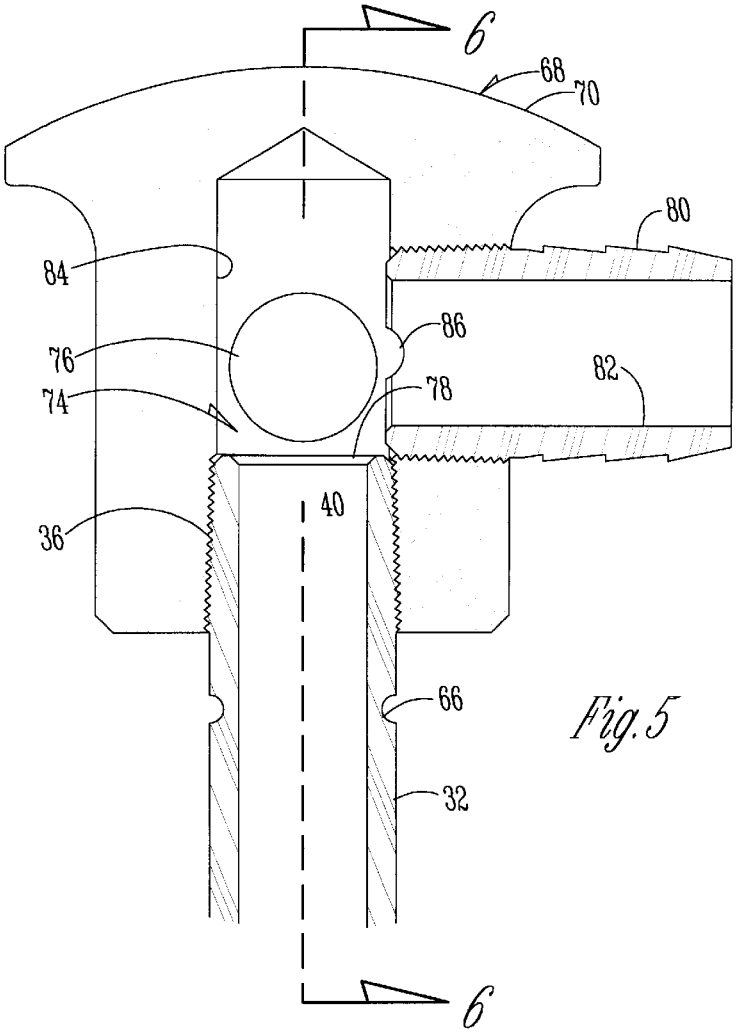
FIG. 5 is an enlarged view of the knob and fluid outlet area of the hand pump of this invention.
Figure 6:
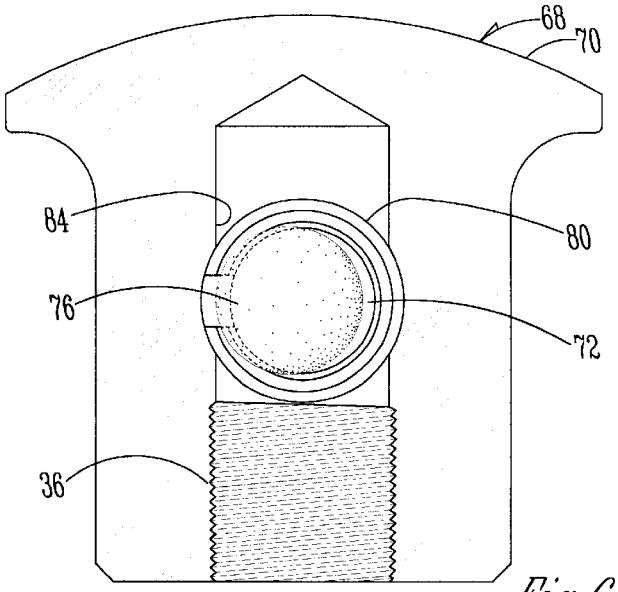
FIG. 6 is a cross-sectional view taken along line 6—6 in FIG. 5 so as to show how a groove in the hose barb prevents the check ball from blocking the fluid outlet.

In operation, the hand pump 10 of this invention is self-priming. The hand pump is installed on the fluid reservoir 24 as shown in FIGS. 1 and 2. The suction hose mounted on the hose barb 88 extends downwardly into the fluid inside the reservoir. A similar hose 90 is attached to the hose barb 80 and fluidly connects the hand pump with a conventional drench probe 92. The drench probe 92 is inserted into the animal's mouth and into its esophagus to dispense the liquid food supplement. An elevating support 94, such as a 5-gallon bucket with dirt or sand can be used to elevate the reservoir 24 above the animal's mouth.

The user inserts the hairpin clip 67 onto one of the grooves 66 on the plunger tube 32 to establish the desired volume or amount of fluid discharged by the pump 10. Then the user primes the pump by depressing the knob 70 until the hairpin clip 67 abuts the cap 50 at the upper end of the body member 12. When knob 70 is released, the spring 48 urges the piston assembly 26 upwardly. This creates a vacuum effect in the fluid chamber 28 that unseats the check ball 44 from the seat 46. Fluid is drawn from the reservoir 24 into the fluid chamber 28. The fluid cannot escape the fluid chamber 28 because the second check valve 74 is urged by gravity to remain closed.

When the user is ready to dispense the liquid food supplement into the animal's esophagus with the drench probe 92, he or she merely reaches over and slaps or pushes the knob 70 downward until the hairpin clip 67 abuts the cap 50. In this manner, a precise and adjustable volume of fluid is quickly and easily dispensed to the animal. Once the user releases the plunger knob 70, the spring 48 automatically raises the piston assembly 26 and the pump 10 is primed for the next use.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as defined in the following claims.

What is claimed is:

1. A self-priming hand pump for dispensing fluid from a reservoir into a bovine's esophagus, comprising:

a body member having upper and lower ends, a cavity formed between the ends, an inlet opening in the lower end of the body member that fluidly connects the cavity with the fluid reservoir, and a hole extending into the cavity through the upper end;

a piston assembly slidably mounted in the cavity so as to define a fluid chamber in a lower portion of the cavity, the piston assembly including a piston secured against axial movement on an elongated hollow plunger tube, the tube having upper and lower ends and an intermediate portion extending outside of the body member, the lower end of the tube extending through the hole in the upper end of the body member and into fluid communication with the fluid chamber, an outlet opening for the fluid chamber being defined at the upper end of the hollow plunger tube outside of the body member;

a first check valve operatively associated with the inlet opening so as to normally block the inlet opening unless the piston assembly moves toward the upper end of the body member thereby creating a vacuum in the fluid chamber and opening the check valve so that fluid flows from the reservoir to the fluid chamber to prime the pump;

a second check valve operatively associated with the outlet opening and disposed at the upper end of the tube so as to normally block the outlet opening until the piston assembly is stroked downwardly toward the lower end of the body member while the first check valve blocks the inlet opening thereby discharging a volume of fluid from the fluid chamber through the outlet opening;

a spring interposed between the body member and the piston assembly so as to yieldingly bias the piston assembly toward the upper end of the body member thereby automatically raising the piston assembly and priming the pump following each downward stroke of the piston assembly;

the plunger being a hollow cylindrical tube and having an outer diameter with a plurality of axially spaced annular grooves formed therein, an abutment member being detachably mounted in one of the grooves and extending radially outward from the plunger tube for abutting the second end of the body member and thereby limiting the axial travel of the piston in one direction.

2. The pump of claim 1 wherein the grooves are equally spaced along the plunger tube whereby the pump displaces a volume of fluid that is adjustable in fixed and equal increments depending upon which groove the abutment member is mounted in.

3. The pump of claim 3 wherein the abutment member is a hairpin clip.

4. A self-priming hand pump for dispensing fluid from a reservoir into a bovine's esophagus, comprising:

a body member having upper and lower ends, a cavity formed between the ends, an inlet opening in the lower end of the body member that fluidly connects the cavity with the fluid reservoir, and a hole extending into the cavity through the upper end;

a piston assembly slidably mounted in the cavity so as to define a fluid chamber in a lower portion of the cavity, the piston assembly including a piston secured against axial movement on an elongated hollow plunger tube, the tube having upper and lower ends and an intermediate portion extending outside of the body member, the lower end of the tube extending through the hole in the upper end of the body member and into fluid communication with the fluid chamber, an outlet opening for the fluid chamber being defined at the upper end of the hollow plunger tube outside of the body member;

a first check valve operatively associated with the inlet opening so as to normally block the inlet opening unless the piston assembly moves toward the upper end of the body member thereby creating a vacuum in the fluid chamber and opening the check valve so that fluid flows from the reservoir to the fluid chamber to prime the pump;

a second check valve operatively associated with the outlet opening and disposed at the upper end of the tube so as to normally block the outlet opening until the piston assembly is stroked downwardly toward the lower end of the body member while the first check valve blocks the inlet opening thereby discharging a volume of fluid from the fluid chamber through the outlet opening;

a spring interposed between the body member and the piston assembly so as to yieldingly bias the piston assembly toward the upper end of the body member thereby automatically raising the piston assembly and priming the pump following each downward stroke of the piston assembly;

a plunger knob having a passageway therethrough fluidly connected to the outlet opening of the pump and detachably mounted to the outlet end of the plunger tube; and a hose barb threadedly connected to the plunger knob and fluidly connected to the outlet opening by the passageway through the knob.

5. The pump of claim 4 comprising an elongated dispensing tube mounted on the hose barb on the plunger knob for fluidly connecting the pump to a drenching probe.

6. A self-priming hand pump for dispensing fluid from a reservoir into a bovine's esophagus, comprising:

a body member having upper and lower ends, a cavity formed between the ends, an inlet opening in the lower end of the body member that fluidly connects the cavity with the fluid reservoir, and a hole extending into the cavity through the upper end;

a piston assembly slidably mounted in the cavity so as to define a fluid chamber in a lower portion of the cavity, the piston assembly including a piston secured against axial movement on an elongated hollow plunger tube, the tube extending through the hole in the upper end of the body member and into fluid communication with the fluid chamber, an outlet opening for the fluid chamber being defined by the hollow plunger tube;

a first check valve operatively associated with the inlet opening so as to normally block the inlet opening unless the piston assembly moves toward the upper end of the body member thereby creating a vacuum in the fluid chamber and opening the check valve so that fluid flows from the reservoir to the fluid chamber to prime the pump;

a second check valve operatively associated with the outlet opening so as to normally block the outlet opening until the piston assembly is stroked downwardly toward the lower end of the body member while the first check valve blocks the inlet opening thereby discharging a volume of fluid from the fluid chamber through the outlet opening;

a spring interposed between the body member and the piston assembly so as to yieldingly bias the piston assembly toward the upper end of the body member thereby automatically raising the piston assembly and priming the pump following each downward stroke of the piston assembly;

the plunger knob having a passageway therethrough fluidly connected to the outlet opening of the pump and attached to the outlet end of the plunger tube;

a plunger knob passageway being generally T-shaped and housing the second check valve, the T-shaped passageway having first, second and third interconnected branches, the first branch being fluidly connected to the cavity through the outlet end of the plunger, the second branch intersecting with and extending laterally from the first branch to an outlet nozzle, the third branch extending upwardly from the intersection of the first and second branches a sufficient distance and being of a sufficient size so as to allow the second check valve to be at least partially disposed in the third branch and uncover the intersection of the first and second branches for fluid through therethrough.

* * * * *